United States Patent [19]

Flanagan et al.

[11] Patent Number: 4,555,598

[45] Date of Patent: Nov. 26, 1985

[54] TELECONFERENCING ACOUSTIC TRANSDUCER

[75] Inventors: James L. Flanagan, Warren; Robert A. Kubli, Whitehouse Station, both of N.J.

[73] Assignee: AT&T Bell Laboratories, Murray Hill, N.J.

[21] Appl. No.: 534,204

[22] Filed: Sep. 21, 1983

[51] Int. Cl.[4] ..... H04R 1/40

[52] U.S. Cl. ..... 179/121 D; 381/87; 181/158; 179/18 BC

[58] Field of Search ..... 381/87, 88, 91, 92; 181/158, 196, 197; 179/121 D, 18 BC

[56] References Cited

U.S. PATENT DOCUMENTS

| | | | |
|---|---|---|---|
| 2,085,130 | 6/1937 | Swickard | 181/158 |
| 2,228,886 | 1/1941 | Olson | 179/121 D |
| 2,262,146 | 11/1941 | Massa | 179/121 D |
| 2,299,342 | 10/1942 | Olson | 179/121 D |
| 2,514,344 | 7/1950 | Slaymaker | 179/121 D |
| 2,739,659 | 3/1956 | Daniels | 179/121 D |
| 2,789,651 | 4/1957 | Daniels | 179/121 D |
| 2,939,922 | 6/1960 | Görike | 179/121 D |
| 3,095,484 | 6/1963 | Beaverson | 179/121 D |
| 3,573,400 | 4/1971 | Sessler | 179/121 D |
| 3,715,500 | 2/1973 | Sessler | 179/121 D |
| 3,793,489 | 2/1974 | Sank | 179/121 D |
| 4,264,790 | 4/1981 | Zlevor | 179/121 D |
| 4,311,874 | 1/1982 | Wallace | 179/1 |

OTHER PUBLICATIONS

Olsen, "Line Microphones", *Proceedings of the Institute of Radio Engineers,* vol. 27, 1939, pp. 438–446.

*Primary Examiner*—Thomas W. Brown
*Assistant Examiner*—L. C. Schroeder
*Attorney, Agent, or Firm*—Jack S. Cubert

[57] ABSTRACT

A directional acoustic transducer includes a plurality of acoustic paths each having first and second ends. The second end of each path terminates in the atmosphere. An electroacoustic device is attached to an acoustic cavity and the acoustic path first ends are coupled to the said acoustic cavity through an acoustic arrangement adapted to produce a predetermined transducer directional response pattern.

11 Claims, 4 Drawing Figures

TELECONFERENCING ACOUSTIC TRANSDUCER

TECHNICAL FIELD

This invention relates to acoustic transducer arrangements and, more particularly, to directional acoustic transducer arrays for teleconferencing facilities.

BACKGROUND OF THE INVENTION

In teleconferencing systems where several persons at a conference room facility are connected to a telephone network or other communication system via a single audio arrangement, reverberation and ambient noise in the room often degrade the audio signal therefrom. It is generally necessary to adapt the system so that speech and other sounds from talker locations in a room are selected for transmission while reverberation and ambient room noise are rejected. Several schemes have been developed to improve the effectiveness of conferencing communication. One type of arrangement utilizes several microphones placed on a conference table, on the conference participants, or in the ceiling of the conference room. In this way, the microphone may selectively discriminate against unwanted sounds. It has been observed, however, that the level of noise and reverberation obtained from such multiple microphone arrangements detracts from the intelligibility of the talker signals.

A vertical line array of microphones such as disclosed in U.S. Pat. No. 4,311,874 issued Jan. 19, 1982 to R. L. Wallace, Jr. and assigned to the same assignee, provides an effective transducer for large groups gathered around conference tables since its directivity pattern is toroidal in the plane of the talker's heads. Such arrays discriminate well against noise and sounds reflected from hard surfaces in a room. A similar toroidal pattern can be obtained using a plurality of acoustic pipes and a single transducer as described in the article, "Line Microphones" by Harry F. Olsen appearing in the *Proceedings of the Institute of Radio Engineers, Vol.* 27, pp. 438–446, July 1939. In order to provide the desired directional response pattern, however, the microphone array must be positioned in the center of the conference table. In such a position, the transducer structure may be distracting to conference participants and may obstruct their view of other participants. It is an object of the invention to provide an improved acoustic transducer structure for teleconferencing arrangements that discriminates against acoustic noise and reverberation without obstructing vision of participants.

BRIEF SUMMARY OF THE INVENTION

The invention is directed to a directional acoustic transducer that includes a plurality of acoustic paths each having first and second ends. The second end of each path terminates in the atmosphere. An electroacoustic device is attached to an acoustic cavity and the acoustic path first ends are coupled to the said acoustic cavity through an acoustic arrangement adapted to produce a prescribed transducer directional response pattern.

DETAILED DESCRIPTION

Figure 1:
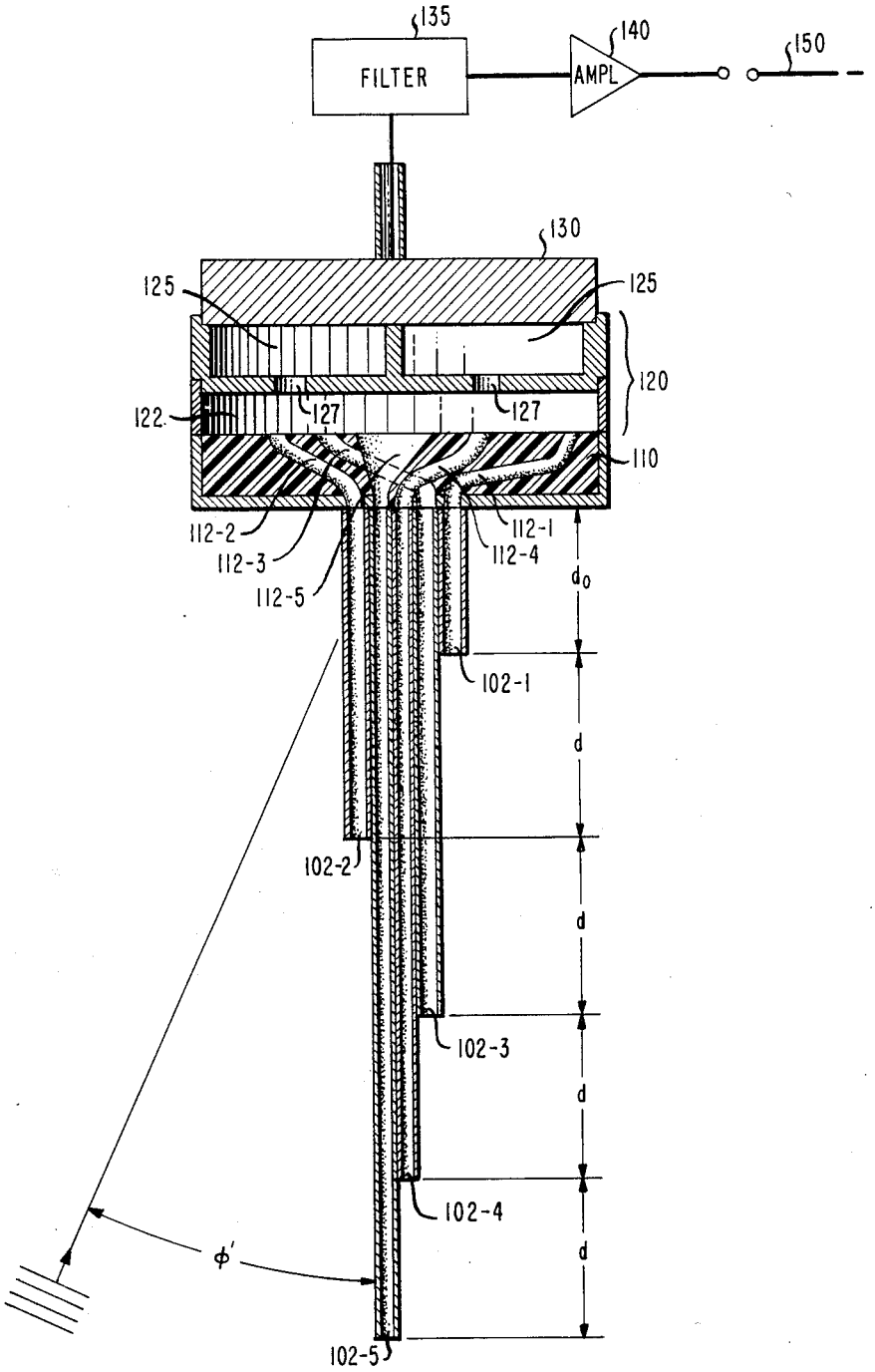
FIG. 1 is a cross section side view of an acoustic transducer structure illustrative of the invention.
Figure 2:
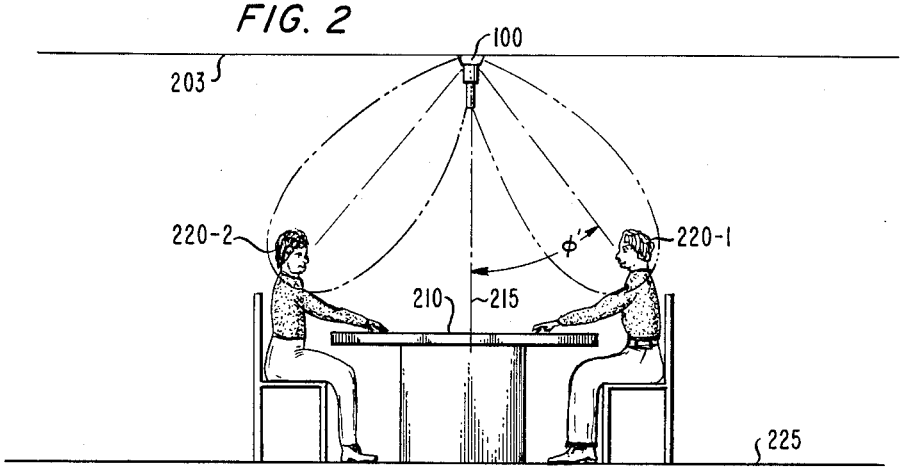
FIG. 2 illustrates an arrangement of the acoustic transducer structure of FIG. 1 in a teleconferencing facility.

FIG. 1 shows a cross section view of an acoustic transducer according to the invention, and FIG. 2 shows the transducer of FIG. 1 set up for use in a conference room environment. Referring to FIG. 2, transducer 100 is mounted on ceiling 203, e.g., 10 feet high, directly above the center 215 of table 210. The transducer may be incorporated in a ceiling ornament or a light fixture. Conference locations in the room are defined by the positions of conference chairs 220-1 and 220-2 around the periphery of table 210. These conference locations are generally at head level, e.g., 3.5 feet above the floor at points around circular table 210 which may, for examle, be 8 feet in diameter and 2.5 feet high. The foregoing dimensions and shapes are exemplary only, and it is to be understood that other dimensions and shapes may also be used.

For a teleconferencing arrangement, transducer 100 should preferably exhibit a directional response pattern that attenuates sounds from points in the room other than the conference locations and should be out of the line of sight of conference participants. These objectives may be accomplished if transducer 100 has a directional response mainlobe that is restricted to the periphery of table 210 at head level of the conferees. Consequently, the mainlobe response of the transducer must be offset from the vertical direction of an angle $\phi$ as indicated in FIGS. 1 and 2 and the transducer should reject sounds from the table center as well as sounds from other than conference locations in the room. A loudspeaker may then be placed on the table where the response of transducer 100 is reduced so that communication with a remote location can be received without interference.

Transducer 100 shown in detail in FIG. 1 comprises acoustical path tubes 102-1 through 102-5. Each tube may, for example, have an inside diameter of 2 mm and may be made of any suitable material. In general, $2N+1$ tubes are used. More precisely defined directional patterns are obtained for higher values of N. One end of each tube terminates in the atmosphere and is effective as a well defined sound aperture. The spaced atmospheric terminated ends form a line array. As is well known in the art, the delay between signals from the pickup points may be adjusted to provide different directional patterns. The other ends of tubes 102-1 through 102-5 terminate in coupler 110 which provides acoustic coupling to acoustic cavity 120. The sounds arriving at the tube pickup ends are subjected to different delays in the acoustic tubes and coupler 110 and are arithmetically summed in cavity section 122. The summed sounds are then appropriately filtered in acoustic filter section 125. Filter 125 may be adjusted to serve as a low-pass bandlimiting filter adapted to protect against spatial aliasing. Microphone 130 is attached to the acoustic filter end of cavity 120 and the electrical signals from the microphone are applied to communication line 150 via filter 135 and amplifier 140.

As is well known in the art, the directional characteristics of a line array transducer structure can be controlled by introducing an appropriate acoustical delay for each pickup point. The complex frequency response for such a line array may be expressed as $$R(j\omega,\phi) = \sum_{n-N}^{N} P_n(j\omega)e^{j\omega \frac{nd}{c}(\cos\phi - \cos\phi')} \quad (1)$$

exclusive of a constant field delay for formal causality. $\omega$ is the radian frequency, $\phi$ is the polar angle between the length of the array and the arriving sound wave, c is the velocity of sound in air, d is the pickup point spacing, $p_n$ $(j\omega)$ is the frequency dependent amplitude weight for the nth receiving pickup point, 2N+1 is the total number of pickup points in the array, and $\phi$ is the steering direction. Steering the mainlobe directional response of the array to an angle $\phi=0$ degrees requires addition of a delay $$\tau_n' = (nd)/c \quad (2)$$

to the nth pickup point. This delay is obtained in the acoustic transducer of FIG. 1 by isolating the sound waves received at each pickup point in a tube of prescribed length. Such an arrangement is known as a "shotgun" microphone and is particularly adapted to produce unidirectional patterns along the axis of the transducer tubes.

In teleconferencing applications such as shown in FIG. 2, it is desired to steer the transducer array mainlobe response to a direction defined by angle $\phi'$ so that the response to sounds from conference locations are accepted but sounds from the center of the table and other portions of the conference room outside the table periphery are substantially attenuated. For the dimensions suggested in FIG. 2, $\phi=30$ degrees is an appropriate steering angle. The steering angle requires a differential delay of $$\delta\tau' = (d/c)\cos\phi' \quad (3)$$

between successive sound pickup points which points are uniformly spaced at distance d.

In order to determine the distances d, between tube pickup points and the number of tubes for the transducer, the frequency response range of the transducer array must be considered. The minimum upper frequency limit for the array of FIG. 1 is $$f_u = \left| \frac{c}{d(\cos\phi - \cos\phi')} \right|_{min} \quad (4)$$

and the lower frequency limit is determined by the relationship $$f_L = \left| \frac{c}{2Nd(\cos\phi - \cos\phi')} \right|. \quad (5)$$

Consequently, the separation distance d is established by the upper useful frequency of the array and N is determined by the lowest useful frequency of the array. Thus, the distance between the sound apertures or pickup points of the successively longer tubes in FIG. 1 is d, obtained from equation (4). Tube 102-2 is longer by a distance d than tube 102-1 and the pickup points at the atmospheric ends of tubes 102-1 through 102-5 are uniformly spaced at distance d. A convenient delay may be added to all tubes by adding a distance $d_o$ as shown in FIG. 1 to separate the tube atmospheric ends from coupler 110.

The reshaping of the directional response of transducer array 100 to produce a 30 degree conical shaped pattern requires a differential delay, i.e., a delay difference between successive output ends in the summing cavity, of 0.866(d/c). The spacing between pickup point apertures, however, is already d as determined by equations (3), (4) and (5) to provide an appropriate frequency range and the differential delay corresponding to the pickup point spacing is d/c. The required differential delay is obtained by additions to the tube lengths in coupler 110 in accordance with the relationship $$(N-n)(1-\cos\phi')(d/c);\ -N \leqq n \leqq N \quad (6)$$

For a steering angle $\phi'=30$ degrees, the increments of delay to the tubes is (0.134)(d/c). Shortest tube 102-1 is connected to addition 112-1 in coupler 110 of length 2N(0.134)d/c. Each succeeding tube 102-2 through 102-4 is connected to a corresponding addition 112-2 through 112-4 in coupler 110; the length of each addition being determined by equation (6). The longest tube 102-5 does not require an extension.

Figure 4:
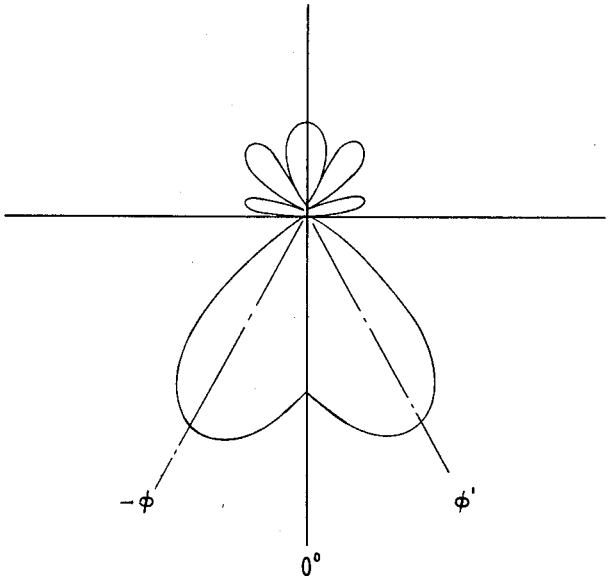
FIG. 4 illustrates the directional response pattern of the acoustic transducer structures of FIG. 1 or 3 at a representative frequency.

FIG. 4 illustrates the directional response of transducer 100 at a frequency of 2500 Hz as a function of angle from the axis of the transducer where coupler 110 is adapted to a steering angle $\phi'$ of 30 degrees. The response pattern varies over the frequency range but generally forms a symmetrical figure of revolution within the predetermined frequency range with the mainlobe response that includes the conference locations and excludes the table center and the remainder of the room. As readily seen, the maximum response is obtained at an angle of 30 degrees from the vertical direction and substantial attenuation is evident between 0 degrees and 20 degrees as well as at angles greater than 40 degrees. In the arrangement of FIG. 2, there is maximum pickup at head level of the conference chair locations and substantial rejection of sounds from other directions including the area of the conference table surface. Advantageously, the transducer provides rejection of extraneous sounds but does not interfere with any participant's view of other conferees.

As described, coupler 110 is constructed to provide a directional response pattern for transducer 100 that is adapted to the conference facility shown in FIG. 2. Changes in dimensions or shape of the conference facility, however, may make the directional pattern inappropriate. The transducer directional response can be altered by changing the structure of tubular elements 112-1 through 112-5. This can be accomplished by making detachable interconnections between coupler 110 and tubes 102-1 through 102-5 as well as acoustic cavity 120 so that coupler 110 may be selected for the particular characteristics of each conference facility. The lengths of tubular elements 112-1 through 112-5 may be changed or the coupler may be adapted to tilt tubes 102-1 through 102-5 at an angle suitable for the conference configuration, e.g., semicircle arrangement. Tubes 102-1 through 102-5 may be rigidly held together by a band or other arrangement such as brazing or soldering well known in the art and the coupling ends of the tube may be constructed so that they are inserted into coupler extension tubes 112-1 through 112-5 so that the acoustical properties of the transducer structure are maintained. Coupler 110 may comprise a molded rubber or plastic insert having extension tubes 112-1 through 112-5 therein. The tubes and the tube assembly, as well as coupler 110, can also be made of plastic or comparable material.

The acoustical waves from coupler 110 are directed into summing cavity 122 and pass therefrom into filter cavities 125 via holes 127. The dimensions of holes 127 and cavities 125 are chosen to pass the sound waves in the audio frequency range selected in accordance with equations (3) and (4) to microphone 130. Filter 135 and amplifier 140 are operative to modify the electrical signal from microphone 130 in accordance with well-known principles for transmission through communication line 150.

The arrangements described with respect to FIGS. 1 and 2 assume a conical shaped transducer response pattern adapted to accommodate a group of conferees seated in a circular pattern. Other conference room configurations may be accommodated by fanning out the pickup points rather than having all tubes perpendicular to the table or tilting the axis of the tubes relative to the conference table top in FIG. 2. Such modifications could provide a directional pattern suitable for rectangular tables or other than circular oriented conference locations.

Figure 3:
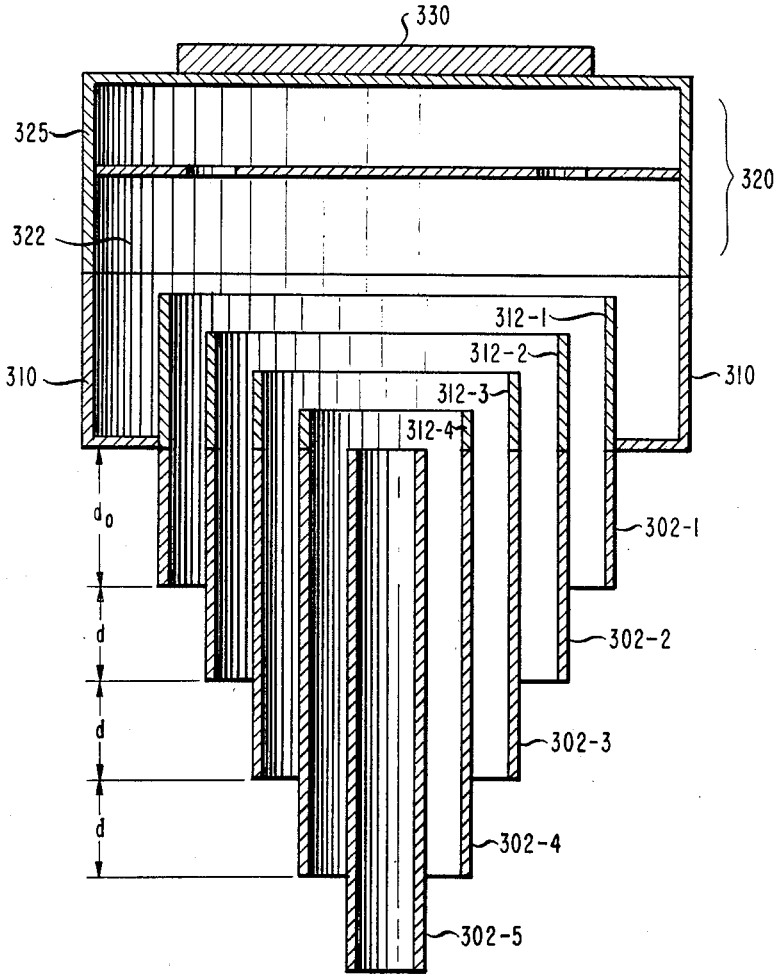
FIG. 3 shows a cross section side view of another acoustic transducer structure that is illustrative of the invention.

FIG. 3 shows another transducer structure illustrative of the invention in which the acoustical paths are a set of $2N+1$ different length coaxial tubes whose atmospheric ends are spaced at distances d to form a stepped array. Referring to FIG. 3, coaxial tubes 302-1 through 302-5 are mounted on coupler 310 so that tube 302-1 connects with tube extension 312-1, tube 302-2 connects with tube extension 312-2, tube 302-3 connects with tube extension 312-3 and tube 304-4 connects with tube extension 312-4. The tubes and the tube extensions may, of course, form part of the same assembly. In this case, the shortest tube and extension protrudes furthest into coupler 310 while the longest tube protrudes the least into coupler 310. The distance between the atmospheric end of each tube and the atmospheric end of the adjacent tube is fixed at d and each tube protrudes into coupler 310 a distance that results in a mainlobe transducer response direction of $\phi'$.

Acoustic cavity 320 comprises summing chamber 322 and filter chamber 325. These chambers function as described with respect to chambers 122 and 125 of FIG. 1. The acoustic waves from filter chamber 325 are converted into an electrical signal by microphone structure 330 and the signal is passed to communication line 350 via filter 335 and amplifier 340. As aforementioned with respect to FIG. 1, coupler 310 may be detachably interconnected to tubes 302-1 through 302-5 and to acoustic cavity 320 so that the coupler may be selected for one of several conference facility configurations.

FIG. 4 also illustrates the directional response pattern of the transducer of FIG. 3 where the coaxial tube cross section areas are the same as the tubes in FIG. 2. As is readily seen, the mainlobe response is centered along an angle of 30 degrees to receive sound waves from the conference locations indicated in FIG. 2. Sound waves from other portions of the conference facility are attenuated so that reflections and ambient noise are suppressed.

The invention has been shown and described with reference to particular embodiments thereof. It is to be understood, however, that various changes and modifications may be made by those skilled in the art without departing from the spirit and scope of the invention.

What is claimed is:

1. A directional acoustic transducer comprising:

a plurality of acoustic paths each having first and second ends, each path second end terminating in the atmosphere;

an acoustic cavity;

an electroacoustic device attached to said acoustic cavity; and means between the acoustic path first ends and said acoustic cavity for coupling said acoustic paths to said acoustic cavity;

said coupling means comprising acoustical means adapted to produce a substantially cone shaped directional response pattern having an apex at the acoustic path second ends.

2. A directional acoustic transducer according to claim 1 wherein said acoustical means adapted to produce a substantially cone shaped directional response pattern comprises:

a coupling chamber between said acoustical path first ends and said acoustic cavity;

said coupling chamber including a plurality of hollow portions each having an end interconnected with one of said acoustic paths first ends and an end interconnected with said acoustic cavity, the lengths of said hollow portions being dimensioned to produce a prescribed cone shaped directional response pattern.

3. A directional acoustic transducer according to claim 2 wherein said coupling chamber is replaceable by a coupling chamber having different dimensioned hollow portion lengths whereby the substantially cone shaped directional pattern is selectable.

4. A directional acoustic transducer according to claim 3 wherein said acoustic cavity comprises:

a first acoustic chamber connected to said coupling means for summing the sound waves from said acoustic path extensions; and a second acoustic chamber connected between said first acoustic chamber and said electroacoustic device adapted to restrict the frequency range of the sound waves applied to said electroacoustic device.

5. A directional acoustic transducer according to claims 1, 2, 3, or 4 wherein the length of each acoustic path is different.

6. A directional acoustic transducer according to claim 5 wherein said acoustic paths are a set of successively longer acoustic tubes, the atmospheric ends of said tubes being separated by multiples of a prescribed distance.

7. A directional acoustic transducer according to claim 6 wherein said set of successively longer acoustic tubes are a set of substantially parallel tubes.

8. A directional acoustic transducer according to claim 7 wherein said set of acoustic tubes are a set of coaxial acoustic tubes.

9. A teleconferencing arrangement comprising:

an acoustic transducer; and a plurality of conference locations;

said acoustic transducer comprising:

a plurality of different length acoustic tubes each having a first end and a second end;

an acoustic cavity;

a microphone attached to said acoustic cavity; and means for coupling the first ends of said acoustic tubes to said acoustic cavity;

said acoustic transducer being at a different height than said predetermined conference locations; and said acoustic transducer coupling means including means for extending the lengths of said acoustic tubes to produce a hollow cone shaped transducer response pattern having its transducer and its base portion directed to the predetermined conference locations.

10. A directional acoustic transducer according to claim 1, 2, 3, or 4 wherein said substantially cone shaped directional pattern is a hollow cone shaped directional pattern.

11. A directional acoustic transducer comprising:

a plurality of acoustic paths each having first and second ends, each path second end terminating in the atmosphere;

an acoustic cavity;

an electroacoustic device attached to said acoustic cavity; and means between the acoustic path first ends and said acoustic cavity for coupling said acoustic paths to said acoustic cavity;

said coupling means adapted to produce a prescribed directional pattern comprises a plurality of acoustic path extensions and means for detachably interconnecting said acoustic path first ends to said extensions; and said acoustic cavity comprises a first acoustic chamber connected to said coupling means for summing the sound waves from said acoustic path extensions and a second acoustic chamber connected between said first acoustic chamber and said electroacoustic device adapted to restrict the frequency range of the sound waves applied to said electroacoustic device.

* * * * *

UNITED STATES PATENT AND TRADEMARK OFFICE

CERTIFICATE OF CORRECTION

PATENT NO. : 4,555,598

DATED : November 26, 1985

INVENTOR(S) : James L. Flanagan and Robert A. Kubli

It is certified that error appears in the above-identified patent and that said Letters Patent is hereby corrected as shown below:

Column 2, line 37, "of" should read --by--, "$\phi$" should read --$\phi'$--. Column 3, line 11, "field" should read --fixed--; line 17, "$\phi$" should read --$\phi'$--; line 19, "$\phi=0$" should read --$\phi'=0$--; line 38 "$\phi=30$" should read --$\phi'=30$--. Column 6, line 27, "paths" should read --path--.

Signed and Sealed this

Sixth Day of January, 1987

*Attest:*

*Attesting Officer*

DONALD J. QUIGG

*Commissioner of Patents and Trademarks*